US005207481A

United States Patent [19]

Ayala, Jr. et al.

[11] Patent Number: 5,207,481

[45] Date of Patent: May 4, 1993

[54] BUMPER APPARATUS FOR HIGH CHAIRS

[75] Inventors: Raymond J. Ayala, Jr.; Sam W. Gainer, both of Houston, Tex.

[73] Assignee: Lil Tot's Safe Care Products Inc., Houston, Tex.

[21] Appl. No.: 858,325

[22] Filed: Mar. 25, 1992

Related U.S. Application Data

[63] Continuation-in-part of Ser. No. 574,776, Aug. 30, 1990, Pat. No. 5,141,286.

[51] Int. Cl.[5] ..... A47D 15/00

[52] U.S. Cl. ..... 297/464; 297/438; 297/423

[58] Field of Search ..... 297/219, 230, 231, 284.5, 297/284.11, 397, 423, 438, 464, 466, 488, DIG. 6; 5/424, 425, 648

[56] References Cited

U.S. PATENT DOCUMENTS

| | | | |
|---|---|---|---|
| 1,964,193 | 6/1934 | Burnett | 297/438 X |
| 3,311,410 | 3/1967 | Hill | 297/423 |
| 4,673,213 | 6/1987 | Bushey et al. | 297/230 X |
| 4,712,833 | 12/1987 | Swanson | 297/464 X |
| 4,744,602 | 5/1988 | Campbell et al. | 297/423 X |
| 4,753,478 | 6/1988 | Weinreich | 297/284 D |
| 4,765,005 | 8/1988 | Hippel | 5/648 |

FOREIGN PATENT DOCUMENTS

| | | | |
|---|---|---|---|
| 1163117 | 9/1969 | United Kingdom | 297/284 D |

*Primary Examiner*—Peter R. Brown
*Attorney, Agent, or Firm*—M. H. Gay

[57] ABSTRACT

The disclosure relates to a high chair restraining means for infants. It consists of a bumper for extending across the front of the seat of a high chair and attachment of the bumper to the vertical posts of a chair. The attachment means provides a bumper that is held against fore and aft movement in the chair. The attachment means illustrated are straps secured to the posts and a bumper carrying dowels with hook for attachment to the posts.

3 Claims, 2 Drawing Sheets

BUMPER APPARATUS FOR HIGH CHAIRS

This application is a continuation-in-art of our pending application Ser. No. 07/574,776 filed Aug. 30, 1990, issued as U.S. Pat. No. 5,141,286 on Aug. 25, 1992, for High Chair Baby Seater.

This invention relates to bumper apparatus for high chairs to position a child in a chair and prevent the child from sliding forward in the chair. The invention may be used to secure infants in high chairs without using awkward or dangerous belts or other means if desired.

Many different solution have been proposed to position a child in a high chair and prevent the child from sliding between the seat and tray of a chair. None of the currently available devices is of similar construction to applicant's. See U.S. Pat. Nos. 1,964,193; 1,000,801; 2,988,135; 2,697,018; 3,311,410; 4,712,833; 4,744,602; 2,820,869; 4,667,993 and Canada 664,599 cited in said pending application for various solutions and ways for fastening devices in place. None of these devices can accommodate differently sized and configured high chairs in as simple and safe a manner as the devices of the present invention. The devices represents an improvement over the prior art in that the device is safe, convenient and easy to manufacture. None of these prior art devices are capable of attachment to high chair side posts and being held by these post against substantial fore and aft movement in the chair.

The bumper apparatus of the present invention is designed to fit onto the majority of the today's available high chairs. In one form the device comprises a bumper, preferably of cylindrical form, through which a strap extends. The bumper is preferably formed of a self skinning thermoplastic material. Attachment means on the strap, preferably D-rings receive the free ends of the strap after they have been wrapped about opposed side posts on a high chair. Preferably the straps are pulled tight to prevent substantial fore and aft movement of the bumper in the chair.

In another form the invention comprises a large bumper, preferably cylindrical, made of wood or similar material and two small dowels made of wood or similar material with securing hooks at each end. The hooks are in resilient relation to each other by means of an elastic means such as a spring, rubber or otherwise stretchable cord that allows the hooks to be stretched onto the framework or vertical support posts that hold up the arms of most modern high chairs. The dowels fit into counterbores in the hole through the bumper and the construction and arrangement of the hooks, dowels and bumper provide a rigid construction that positions the apparatus between the side posts and prevents substantial fore and aft movement of the bumper relative to the chair.

It is an object of this invention to provide a high chair bumper apparatus that is safe as well as comfortable.

Another object is to provide a high chair bumper apparatus that may be easily attached to side posts of a high chair and retained by these side posts against substantial fore and aft movement in the chair Another object is to provide a bumper easily molded from a self skinning thermoplastic such as polyurethane.

Another object is to provide a bumper with a longitudinally extending strap which is provided with friction attachment means which automatically lock the bumper in place when the free ends of the strap are pulled tight.

Another object is to provide a bumper with dowels carrying hooks for receiving chair side posts in which resilient means urge the dowels into counterbores in the bumper to provide a substantially rigid structure when hooked to side posts of a chair which is held against fore and aft movement relative to the chair. Another objective of the invention is to provide a device that will secure an infant in a high chair and accommodate a wide range of high chairs that vary in size and configuration.

Another objective is to provide a high chair securing means that can be easily and inexpensively produced.

Other objects, features, and advantages of the invention will be apparent from the specification, the drawings and the claims.

In the drawings, wherein illustrative embodiments of the invention are shown and wherein like reference numerals indicate like parts:

The apparatus of this invention includes a bumper for bumping the buttocks of an infant to retain the infant in a high chair as the infant tries to slide between the seat and tray of a high chair. The bumper may be of any desired form which will be comfortable to the infant. Preferably at least a portion of the bumper will be curved to engage the legs of the infant. Preferably the bumper is substantially cylindrical in shape.

The apparatus is attached to side post of the conventional high chair. The attachment means extends through the bumper and attaches to the side post. The attachment means provides for positioning the bumper between the side post and prevents substantial fore and aft movements of the bumper. It also substantially prevents entry of food into the hole through the bumper. It is desirable to prevent fore and aft movement of the bumper to prevent an infant from using the bumper to provide leverage to stand up in the chair or to permit the bumper to be pushed over the front of the seat by an infant. The legs of an infant over the bumper will hold it against the seat. If it is prevented from substantial movement fore and aft of the chair by the attachment means it will always be in position to retain the infant in a chair.

Figure 1:
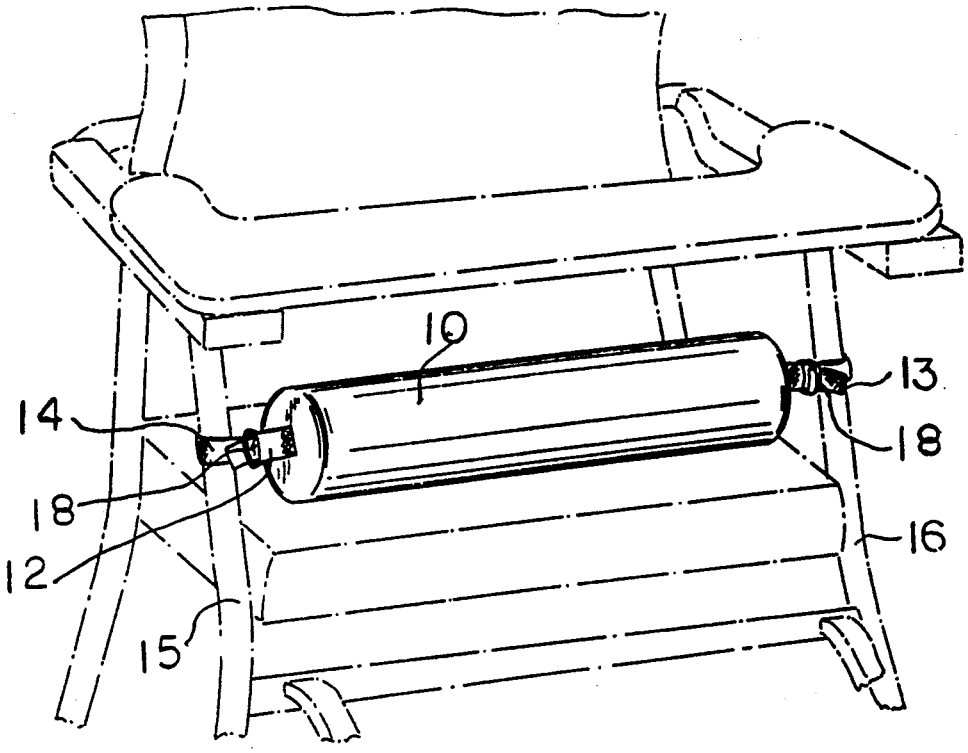
FIG. 1 shows a high chair in phantom with the preferred form of apparatus shown attached to opposed side posts of the chair.
Figure 2:
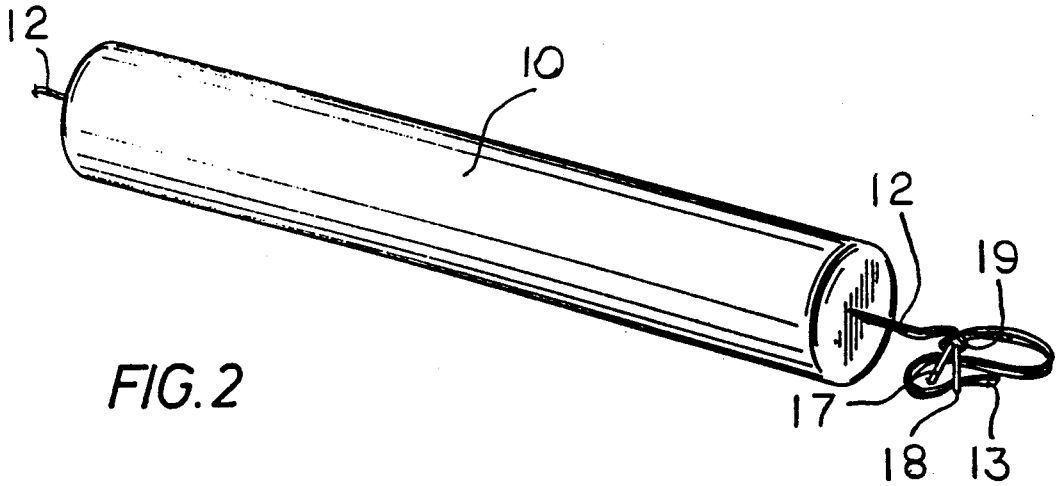
FIG. 2 is a perspective view of the apparatus with one attachment means omitted.
Figure 3:
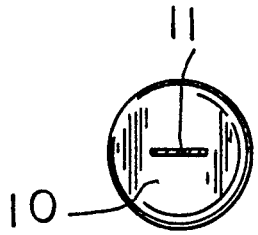
FIG. 3 is an end view of the apparatus showing the strap closely contained in the hole through the bumper.

The preferred form of the invention is shown in FIGS. 1, 2 and 3. The bumper 10 is preferably cylindrical in shape. An acceptable dimension is 10½ inches in length and 2¼ inches in diameter. The bumper is preferably formed from plastic material such as a thermoplastic. Preferably the material is foamed polyurethane which is self skinning during the molding process. A suitable type of foamed polyurethane is that made by BASF Corp, Polymers Division of Wyandotte, MI. This product known as "Integral Skin Flexible Foam" is described as XUC 28083 Resin/WUC 3092T (SAND 150). It has a mix ration of 36.7 pbw WUC 3196T Isocyanate and 100pbw WUC 28083 resin. Recommended processing conditions; resin: 70–80 degrees fahrenheit, Iso: 70–80 fahrenheit. Mold temperature: 120–130 degrees, Demold time: 3–5 minutes, molded density: 10–30 pfc.

Foamed polyurethane is the preferred material as this will not lead to chafing of the infant's skin when in contact for extended periods. This is important as the bumper piece is placed under the thighs of the infant and so tends to rub against them, if the infant is not wearing pants, etc. over the thighs. Chafing may develop with other materials. Other types of polymeric materials may also be used provided that they will not cause chafing of the infant's thighs when in contact with them.

To receive the retaining means the bumper has a hole extending through its length or cylindrical axis. This hole may be a slot 11 which extends the length of the bumper. The slot 11 may be provided in any desired manner such as by a mandrel in the mold so that the slot is formed during the molding process.

The attachment system for holding the bumper between the side posts includes a non-resilient strap having an intermediate portion 12 and two end portions 13 and 14. For instance the strap may be formed of nylon material.

Attachment means is positioned on the intermediate section of the strap on opposite sides of the bumper and adjacent thereto. The attachment means is preferably of a type which receives the free ends 13 and 14 of the strap after they have been wrapped about the posts 15 and 16 of a high chair, and provide a frictional engagement therewith which permits the free ends to be pulled tight and place the intermediate section of the strap in tension. In the preferred form of the invention a pair of D-shaped rings 17 and 18 are carried by the intermediate section of the strap on one side of the bumper 10 and receive the free end 13 of the strap. A like pair of D-rings 17 and 18 are carried on the intermediate section 12 of the strap at the other end of the bumper and receive free end 14 of the strap. The D-rings may be fastened to the strap in any desired manner. Preferably a loop 19 is provided in the strap and the strap sewed together at the loop with the two D-rings in the loop. Any other type of friction fastener may be utilized.

The apparatus is secured to a high chair by positioning the bumper 10 between the chair posts, extending the free ends 13 and 14 of the strap around the chair posts 15 and 16 and lacing the free ends of the strap through the D-rings in the conventional manner as shown in FIG. 2. The free ends of the strap may be pulled tight to hold the bumper in position so that the bumper cannot move fore and aft of the chair. Preferably the intermediate section of the bumper is placed in tension to insure the operation of the D-ring fasteners and prevent any substantial movement of the bumper 10. By preventing fore and aft movement of the bumper it is insured that an infant would have great difficulty in use the bumper to stand up in the chair. The frictional engagement of the strap with the chair posts 15 and 16 will hold the bumper down against the seat as will the legs of the infant and make it difficult to slide a foot between the chair seat and bumper.

Figure 4:
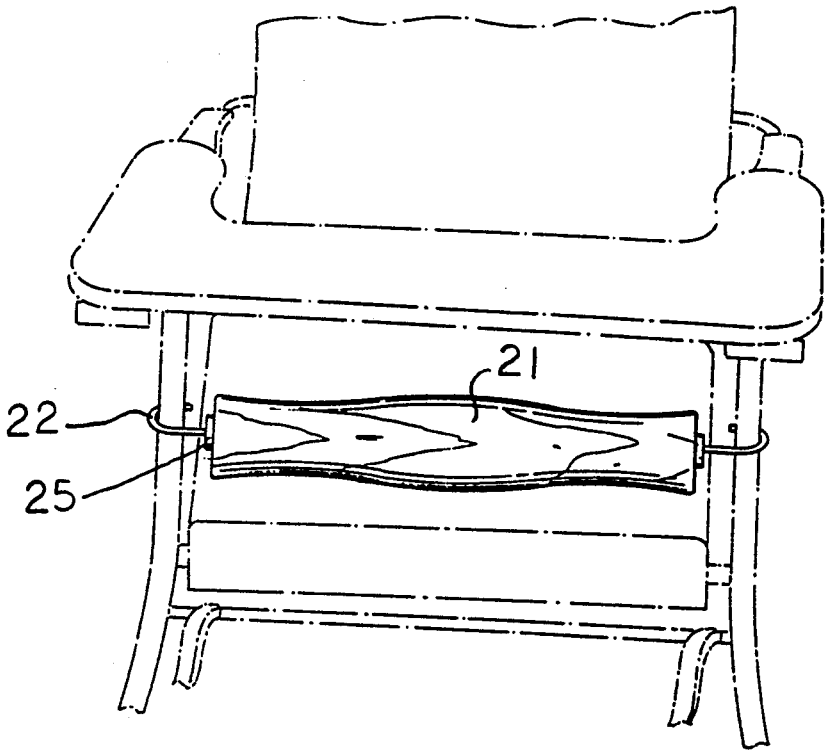
FIG. 4 is a view similar to FIG. 1 illustrating a different form of this invention.
Figure 5:
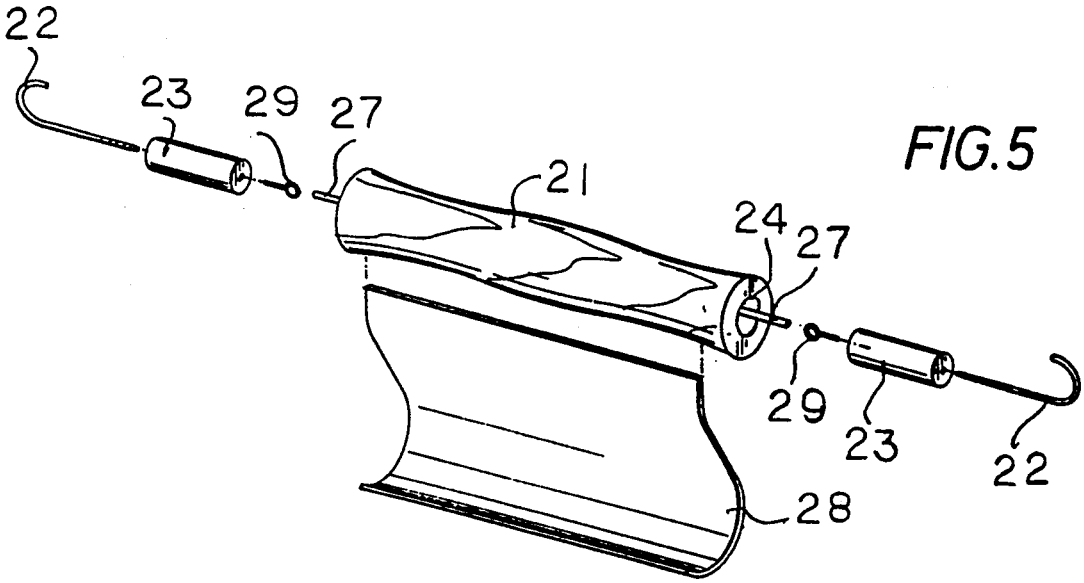
FIG. 5 is an expanded view of the FIG. 4 form of this invention.
Figure 6:
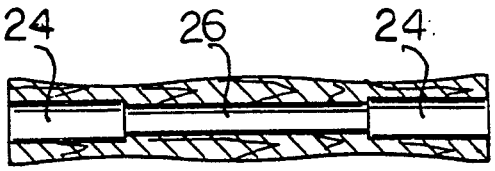
FIG. 6 is a section through the bumper of FIG. 4.

An alternate form of the invention is shown in FIGS. 4, 5 and 6. This apparatus has a generally cylindrical bumper 21 made of wood, plastic or other suitable material that is secured to the support posts 15 and 16 that come with most modern high chairs by means of a securing or attachment means that includes hooks 22 at one end of each of the small dowels 23. The small dowels 23 (FIG. 5) fit within the hollowed out interior portion or counterbores 24 of the bumper 21. The small dowels are placed so that a portion of each 25 (see FIG. 4) protrudes outside to the bumper (designated the "exterior end"). This makes for two ends for each of the small dowels, designated the "interior" and "exterior ends depending on their relation to the bumper.

The securing means 22 (see FIG. 5) are attached to the exterior ends of the small dowels so that they protrude out of the ends of the bumper when the apparatus is constructed. The securing or attaching means are then connected to the vertically oriented support posts 15 and 16 (FIG. 4) of the frame of the high chair to secure the bumper in place under the thighs of the infant.

The small dowels that support the securing means are connected through a hole 26 in the bumper which connects the counter bores 24. The hole 26 and counterbores 24 provide together a hole through the length dimension of the bumper 21. The connection is provided by a resilient member 27 (FIG. 5) that is placed through the hole in the bumper 21. This also keeps the apparatus attached to the high chair and makes it very difficult for the infant to work himself or herself out of the high chair.

The apparatus is constructed with a bumper that may be padded with material 28 (FIG. 5), or otherwise made to be comfortable against the back of the thighs of the infant. The bumper should be of strong durable material as it must resist the force of the infant if he or she attempts to struggle out of the high chair.

When used the apparatus is placed under the thighs of the infant and then secured into place around the vertical posts of the high chair by means of the hooks 22. The bumper helps resist the struggles of the infant to get out of the seat.

Referring to FIG. 5, inside the bumper is an elastic piece 27, which can be make of rubber, elastic, or other similar material. The elastic piece is connected by eye hooks 29 or other attaching means to the interior ends of each small dowel 23, the interior ends of the small dowel being those ends of each small dowel that remain inside the bumper when the apparatus is constructed. To complete the device, two large plastic or rubber coated hooks 22 (or other attaching means capable of being secured to the vertical posts) are attached to the external ends of the two small dowels, i.e.: those ends of each of the small dowels that stick out of the ends of the bumper when used.

Because the two securing means are in resilient relation to each other many of the advantages of the present invention are realized. The securing means can resist the tugs or pushes of the infant and thus secure him or her in the high chair. The securing means can thus be arranged to fit the majority of high chairs currently available since the securing means may be stretched to fit the distance between the vertically oriented support posts on the high chair.

The securing means may comprise any means that are capable of fitting in connection with the vertical posts that are usually found on high chairs. It is preferred that the securing means be hooks since they can readily be fit around the vertical posts. Other securing means may comprise Velcro (trademark name for hook and loop material), snap hooks that have to be opened and to be used and can then be closed after they are placed around the posts. These would provide an additional securing feature.

As in the preferred form of the invention the construction and arrangement of the hook, dowels and bumper are such that the apparatus when attached to high chair posts is substantially fixed in place and held against substantial fore and aft movement in a chair as the bumper, dowels and hooks provide a substantially rigid structure.

The foregoing disclosure and description of the invention are illustrative and explanatory thereof and various changes in the method and apparatus and system and in the size, shape and materials, as well as in the details of the illustrated construction, may be made within the scope of the claims without departing from the spirit of the invention.

What is claimed is:

1. Apparatus for securing infants securely within a high chair having opposed side posts extending upwardly from the high chair seat comprising:

an elongate bumper for positioning on the high chair seat between opposed side posts of the chair, said bumper having a hole extending through its elongate dimension, a non-elastic strap having an intermediate section extending through said hole and end sections on opposite sides of said intermediate section, two attachment means on said strap intermediate section positioned one on each side of said bumper and closely adjacent thereto limiting relative movement between said intermediate strap section and said bumper while in use, each attachment means provided by a pair of D-rings attached to the intermediate strap section and adapted to engage one of said end sections at any of various selected positions along its length after it has been wrapped about high chair posts on opposite sides of a high chair and hold said strap intermediate section in tension and prevent movement of said bumper fore and aft of said chair.

2. The apparatus of claim 1 wherein said bumper is cylindrical in form and formed from foamed thermoplastic material having an impervious exterior skin.

3. The apparatus of claim 1 wherein said bumper is cylindrical in form and formed from a self skinning foamed polyurethane and said strap substantially fills said hole.

* * * * *